US009184510B2

(12) United States Patent
Chakam

(10) Patent No.: US 9,184,510 B2
(45) Date of Patent: Nov. 10, 2015

(54) ANTENNA STRUCTURE FOR A VEHICLE

(75) Inventor: Guy-Aymar Chakam, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 600 days.

(21) Appl. No.: 13/522,275

(22) PCT Filed: Jan. 12, 2011

(86) PCT No.: PCT/EP2011/050361

§ 371 (c)(1),
(2), (4) Date: Oct. 18, 2012

(87) PCT Pub. No.: WO2011/086107

PCT Pub. Date: Jul. 21, 2011

(65) Prior Publication Data

US 2013/0027258 A1 Jan. 31, 2013

(30) Foreign Application Priority Data

Jan. 13, 2010 (DE) ..... 10 2010 004 470

(51) Int. Cl.
*H01Q 21/24* (2006.01)
*H01Q 9/16* (2006.01)
*H01Q 19/00* (2006.01)

(52) U.S. Cl.
CPC ..... *H01Q 21/24* (2013.01); *H01Q 9/16* (2013.01); *H01Q 19/005* (2013.01)

(58) Field of Classification Search
CPC ..... H01Q 21/24; H01Q 21/26; H01Q 21/28
USPC ..... 343/725, 727, 797, 806
See application file for complete search history.

(56) References Cited

U.S. PATENT DOCUMENTS

| | | | | |
|---|---|---|---|---|
| 6,072,439 | A | 6/2000 | Ippolito et al. | 343/797 |
| 6,211,840 | B1 | 4/2001 | Wood et al. | 343/793 |
| 6,329,954 | B1 * | 12/2001 | Fuchs et al. | 343/725 |
| 6,812,902 | B2 | 11/2004 | Rossman et al. | 343/725 |
| 7,280,082 | B2 | 10/2007 | Theobold et al. | 343/797 |

(Continued)

FOREIGN PATENT DOCUMENTS

| | | | |
|---|---|---|---|
| DE | 1930660 A1 | 1/1971 | H01P 5/10 |
| DE | 19901179 A1 | 7/1999 | H01Q 1/24 |

(Continued)

OTHER PUBLICATIONS

German Office Action, Application No. 10 2010 004 470.9-55, 3 pages, Jul. 30, 2010.

(Continued)

*Primary Examiner* — Robert Karacsony
(74) *Attorney, Agent, or Firm* — Slayden Grubert Beard PLLC

(57) ABSTRACT

An antenna structure for a vehicle may include an electrically conductive structure arranged on two insulating substrate plates that are arranged perpendicularly to each other and intersect each other. A dipole is provided on each electrically conductive structure. The dipoles form a first U-shaped dipole structure on each of the two substrate plates. On an upper edge region of each of the substrate plates, the dipole structure has a line element, and on the lateral regions of the substrate plate, the dipole structure has electrically conductive limbs. The electrically conductive structure has a monopole arranged asymmetrically to the dipole structure for respectively feeding the dipole.

16 Claims, 4 Drawing Sheets

(56) References Cited

U.S. PATENT DOCUMENTS

| | | | | |
|---|---|---|---|---|
| 7,999,752 | B2 | 8/2011 | Riedel | 343/797 |
| 2007/0210976 | A1 | 9/2007 | Luk et al. | 343/793 |
| 2013/0027258 | A1 | 1/2013 | Chakam | 343/727 |

FOREIGN PATENT DOCUMENTS

| | | | | |
|---|---|---|---|---|
| DE | 202004003312 | U1 | 5/2004 | H01Q 1/12 |
| DE | 102006039279 | A1 | 2/2008 | H01Q 21/24 |
| GB | 2176660 | A | 12/1986 | H01Q 21/29 |
| WO | 01/76007 | A1 | 10/2001 | H01Q 1/22 |
| WO | 01/76012 | A1 | 10/2001 | H01Q 19/10 |
| WO | 2005/041357 | A1 | 5/2005 | H01Q 1/12 |
| WO | 2011/086107 | A1 | 7/2011 | H01Q 19/00 |

OTHER PUBLICATIONS

International Search Report and Written Opinion, Application No. PCT/EP2011/050361, 15 pages, May 9, 2011.

* cited by examiner

ANTENNA STRUCTURE FOR A VEHICLE

CROSS-REFERENCE TO RELATED APPLICATIONS

This application is a U.S. National Stage Application of International Application No. PCT/EP2011/050361 filed Jan. 12, 2011, which designates the United States of America, and claims priority to German Application No. 10 2010 004 470.9 filed Jan. 13, 2010, the contents of which are hereby incorporated by reference in their entirety.

TECHNICAL FIELD

This disclosure relates to an antenna structure for a vehicle. The antenna structure has an electrically conductive structure which is arranged on two insulating substrate plates which are arranged at a right angle to one another and intersect. A dipole is provided in each case on the electrically conductive structure. The dipoles each form a first U-shaped dipole structure on the two substrate plates. The dipole structure has in each case a line element on an upper edge region of the substrate plate, and electrically conductive limbs on side regions of the substrate plate.

BACKGROUND

An antenna structure is known from document U.S. Pat. No. 6,329,954 B1 for a combination antenna for satellites and terrestrial reception. The known antenna structure includes a cruciform dipole for receiving a satellite signal with circular polarization and a multiplicity of monopoles for receiving terrestrial signals with linear polarization. The monopoles are for this purpose arranged symmetrically around the cruciform dipole. A disadvantage of the known antenna structure is that separate supply points must be provided for the monopole antenna and for the cruciform dipole antenna, which results in a considerable space requirement and additional costs.

SUMMARY

In one embodiment, an antenna structure for a vehicle comprises: two insulating substrate plates which are arranged at a right angle to one another and intersect; an electrically conductive structure which is arranged on the substrate plates and comprises the following features: a first U-shaped dipole structure which is arranged in each case on one of the substrate plates in such a way that it has a line element on an edge region of the respective substrate plate, and electrically conductive limbs on side regions of the respective substrate plate, and a monopole which is arranged on one of the substrate plates, asymmetrically with respect to the first U-shaped dipole structure for respectively supplying the dipole structure.

In a further embodiment, the monopole is arranged at an electromagnetically coupling distance from one of the limbs of the first U-shaped dipole structure. In a further embodiment, a second U-shaped dipole structure for a higher frequency band is respectively arranged on the intersecting substrate plates, and wherein the dimensions of the second dipole structure are smaller than the dimensions of the first dipole structure. In a further embodiment, the respective second U-shaped dipole structure is arranged at an electromagnetically coupling distance from the respective first dipole structure.

In a further embodiment, the respective second U-shaped dipole structure is arranged at an electromagnetically coupling distance from the monopole. In a further embodiment, the monopoles of the substrate plates are electrically connected to supply points on the respective substrate plate via an inductive coupling loop or a matching network composed of line elements. In a further embodiment, a first of the vertically arranged substrate plates has a central vertical gap in which the second intersecting substrate plate is arranged which has at its upper edge a gap-shaped recess in which the upper edge of the first substrate plate is arranged. In a further embodiment, the intersecting substrate plates have, at their lower edge regions, solder connection faces with which they can be surface-mounted on a horizontal component mounting board.

In a further embodiment, the first intersecting dipole structure is configured for frequencies f1 of a Wimax data service between 2.3 GHz≤f1≤2.7 GHz or between 2.496 GHz≤f1≤2.7 GHz or between 3.3 GHz≤f1≤3.8 GHz. In a further embodiment, the second dipole structure is configured for frequencies f2 of an inter-vehicle information exchange service or "car-to-car" service between 5.875 GHz≤f2≤5.925 GHz or for frequencies f1 of a Wimax data service between 3.3 GHz≤f1≤3.8 GHz. In a further embodiment, the monopole is configured for the frequencies f2 of the inter-vehicle information exchange service or "car-to-car" service between 5.875 GHz≤f2≤5.925 GHz. In a further embodiment, the monopole has an ellipsoidal face whose longitudinal extent also determines a lower frequency limit of 5.875 GHz and whose transverse extent defines an upper frequency limit of 5.925 GHz.

In another embodiment, a vehicle includes an antenna structure having any of the features discussed above. In a further embodiment, the intersecting substrate plates are arranged oriented vertically in an outer region of the vehicle.

BRIEF DESCRIPTION OF THE DRAWINGS

Example embodiments will be explained in more detail below with reference to FIGS. 1A-4, in which.

DETAILED DESCRIPTION

Figure 1B:
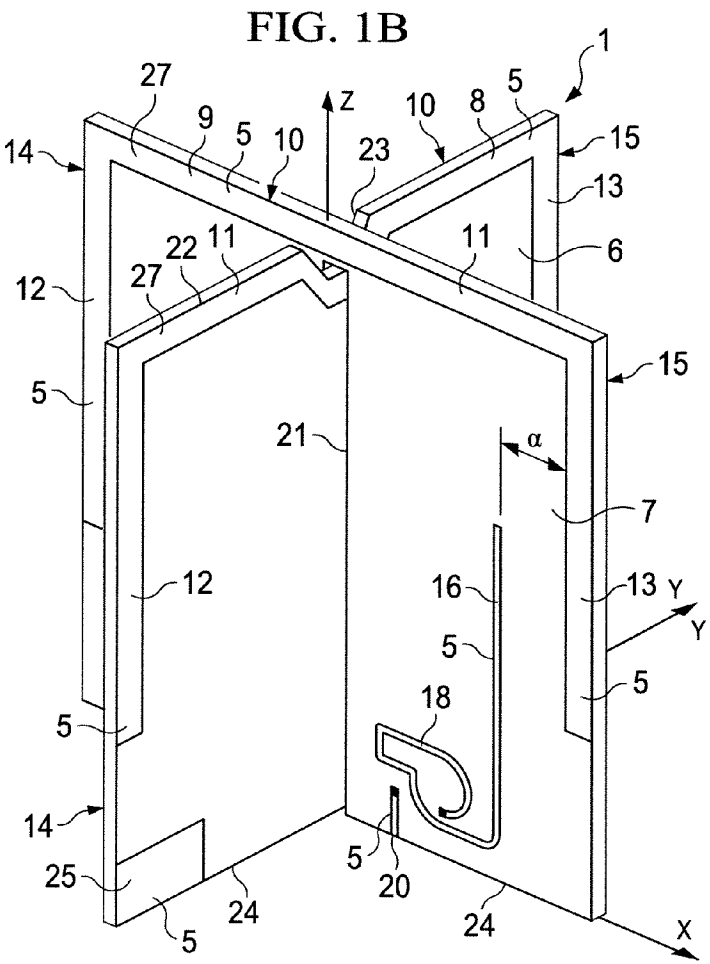
FIGS. 1A and 1B show a schematic perspective view of an antenna structure according to a first example embodiment.

Some embodiments provide for integration of MIMO antennas (multiple in and multiple out antennas) for a Wimax data service which can be integrated into existing antenna structures in a space-saving and cost-effective fashion.

For example, some embodiments provide an antenna structure for a vehicle. The antenna structure has an electrically conductive structure which is arranged on two insulating substrate plates which are arranged at a right angle to one another and intersect. A dipole is provided in each case on the electrically conductive structure. The dipoles each form a first U-shaped dipole structure on the two substrate plates. The dipole structure has a line element on an upper edge region of a respective substrate plate, and electrically conductive limbs on side regions of the substrate plate. The electrically conductive structure has in each case a monopole which is arranged asymmetrically with respect to the dipole structure, for respectively supplying the dipole.

With this antenna structure it is possible to supply both the monopole and the dipole via the monopole and therefore via a single supply point per substrate plate. The dipoles of the two substrate plates which are arranged at a right angle to one another permit the two dipoles to be decoupled with the result that a multiple-antenna system is produced. Furthermore, the signals are not coupled centrally and symmetrically into the dipoles but rather asymmetrically by virtue of the fact that the monopole is arranged at an electromagnetically coupling distance from one of the limbs or the end of the dipoles. In this context, the intersecting substrate plates can be oriented vertically, in particular in the case of installation on the vehicle, and arranged in an outer region of the vehicle.

With such an antenna structure which is provided with intersecting dipoles it is possible, depending on the configuration of the line element at the upper edge of the substrate plates and the configuration of the limbs on the side regions of the substrate plates, to operate the different frequency bands of what are referred to as Wimax data services between 2.3 GHz≤f1≤2.7 GHz or the Wimax data services of the USA with frequencies f1 between 2.496 GHz≤f1≤2.7 GHz or the Europe-wide Wimax data services between 3.3 GHz≤f1≤3.8 GHz.

In a further embodiment, the coupling monopole can be configured in such a way that it serves an inter-vehicle information exchange service or "car-to-car" service with frequencies f2 between 5.875 GHz≤f2≤5.925 GHz and at the same time ensures coupling to the dipole structure.

In a further embodiment, the monopole has an ellipsoidal face whose longitudinal extent also determines a lower frequency limit of 5.875 GHz and whose tansverse extent defines an upper frequency limit of 5.925 GHz for the inter-vehicle information exchange service.

In a further embodiment, in each case second U-shaped dipole structures for a higher frequency band than the first dipole structure are arranged on the intersecting substrate plates. For this purpose, the dimensions of the second dipole structures are smaller than the dimensions of the first dipole structures.

An above-mentioned, second U-shaped dipole structure can be arranged at an electromagnetically coupling distance from the first dipole structure. On the other hand, it is also possible to arrange the second U-shaped dipole structure at an electromagnetically coupling distance from the monopole. With such configuration, the relatively high frequency band for the inter-vehicle information exchange service does not increase the space required for the antenna structure, but further services are integrated into the multiple-antenna system.

Furthermore it is provided that the monopoles of the substrate plates are electrically connected to corresponding supply points on the respective substrate plate via an inductive coupling loop or a matching network composed of line elements.

In order to implement these structures in an optimum way in the smallest possible space, a first of the (vertically arranged) substrate plates has a central (vertical) gap in which the second intersecting substrate plate is arranged. In other words, given a possible vertical orientation of the first substrate plate, the central gap also runs in a vertical direction with the result that the second substrate plate can also be arranged vertically oriented in the first substrate plate. The second intersecting substrate plate for its part has, at an upper edge, a gap-shaped recess in which the upper edge of the first substrate plate is arranged. The line element in the upper edge region of the two intersecting substrate plates is correspondingly matched to the recess in the second substrate plate, while the line element in the upper edge region of the first substrate plate can be provided linearly.

Furthermore there is provision that solder connection faces are applied in the lower edge regions of the intersecting substrate plates, with which solder connection faces these substrate plates can be surface-mounted on a horizontal component mounting board.

Such an antenna structure can be used for road vehicles, water craft, rail vehicles and aircraft.

Figure 1A:
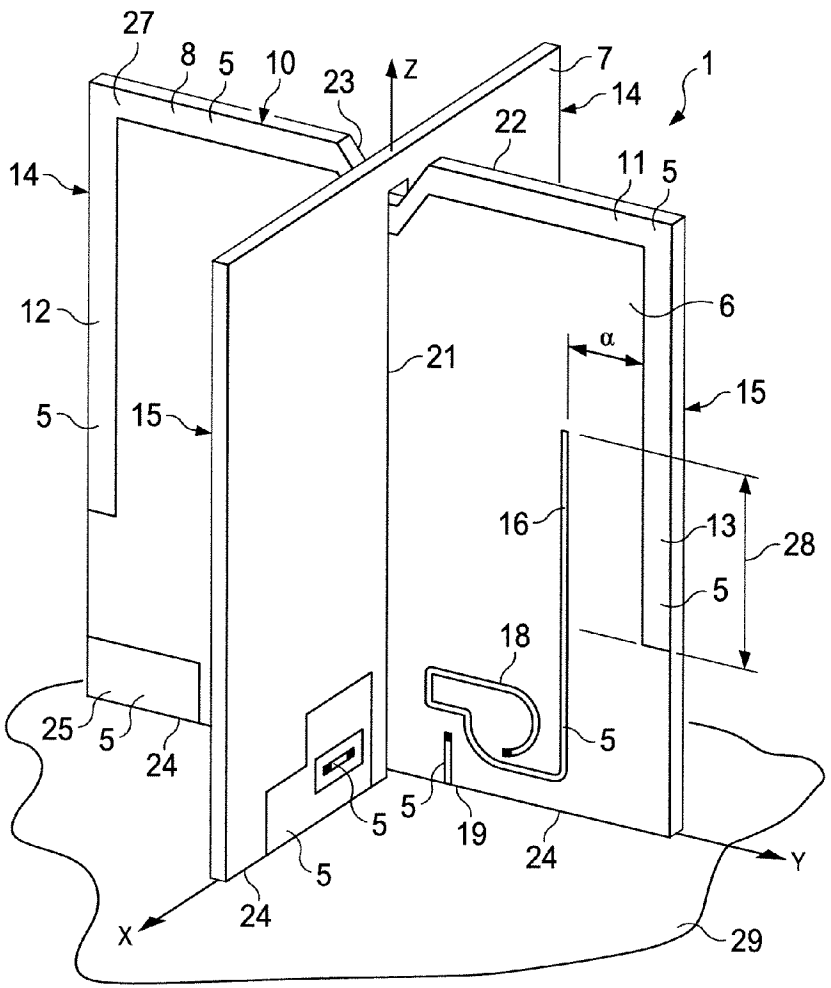

FIGS. 1A and 1B show a schematic perspective view of an antenna structure according to a first example embodiment. The antenna structure 1 shown in FIG. 1 has a multiple antenna composed of two cruciform dipoles. The cruciform dipoles 8 and 9 are applied by a conductive structure 5 to insulating substrate plates 6 and 7 which intersect at a right angle, wherein FIG. 1A shows the substrate plate 6 with its conductive structure 5, and FIG. 1B shows the substrate plate 6 arranged rotated through 90° about the axis Z with respect to FIG. 1A, with the result that the conductive structure 5 of the second substrate plate 7 can now also be seen.

The dipoles 8 and 9 have virtually the same structure, wherein a first U-shaped dipole structure 10 can be seen on the substrate plate 6 in FIG. 1A. The U-shaped dipole structure 10 has in an upper edge region a line element 27 which merges with electrically conductive limbs 12 and 13 at the side regions 14 and 15. The line element 27 follows the contour of the upper edge region 11, which has a central recess 23, in order to permit the right-angled arrangement of the substrate plates 6 and 7 without the two dipoles being galvanically connected. The dipole 8 of the substrate plate 6 is not supplied symmetrically via a central axle but instead asymmetrically by means of a monopole 16, which is arranged along a coupling region 28 at an electromagnetically coupling distance a from the limb 13 or the end of the dipole 8. The monopole 16 is itself electrically connected to a supply point 19 via a coupling loop 18.

The conductive structure 5 of the second substrate plate 7 can be seen in FIG. 1B and has the same structure as the substrate plate 6 in FIG. 1A. A dipole 9, corresponding to the dipole 8 which has the U-shaped dipole structure 10 in FIG. 1A, is also implemented here. All that is arranged in the upper edge region 11 is a line element 27 which is oriented in a linear fashion, while the line element 27 of the first dipole 8 has, on the first substrate plate 6, a contour which is matched to the upper edge region of the substrate plate 6.

A central gap 21, in which the first substrate plate 6 is inserted in order to arrange the two substrate plates 6 and 7 and therefore the dipoles 8 and 9 at a right angle to one another, is provided in the second substrate plate 7. As a result of this right-angled arrangement, the two dipoles are not coupled to one another, with the result that the second dipole 9 can be supplied via a separate supply structure with a coupled monopole 16 at an electromagnetically coupling distance a from the limb 13 of the dipole 9.

The two substrate plates 6 and 7 therefore have identical conductive structures 5, wherein the substrate plate 7 has an additional supply point 20, which again supplies the monopole 16, and therefore also the dipole 9, via a coupling loop 18. Furthermore, a solder connection face 25 is arranged in FIG. 1B in the lower edge region 24, with which the cruciform dipole can, as shown in FIG. 1, be secured on a horizontal printed circuit board.

Figure 2:
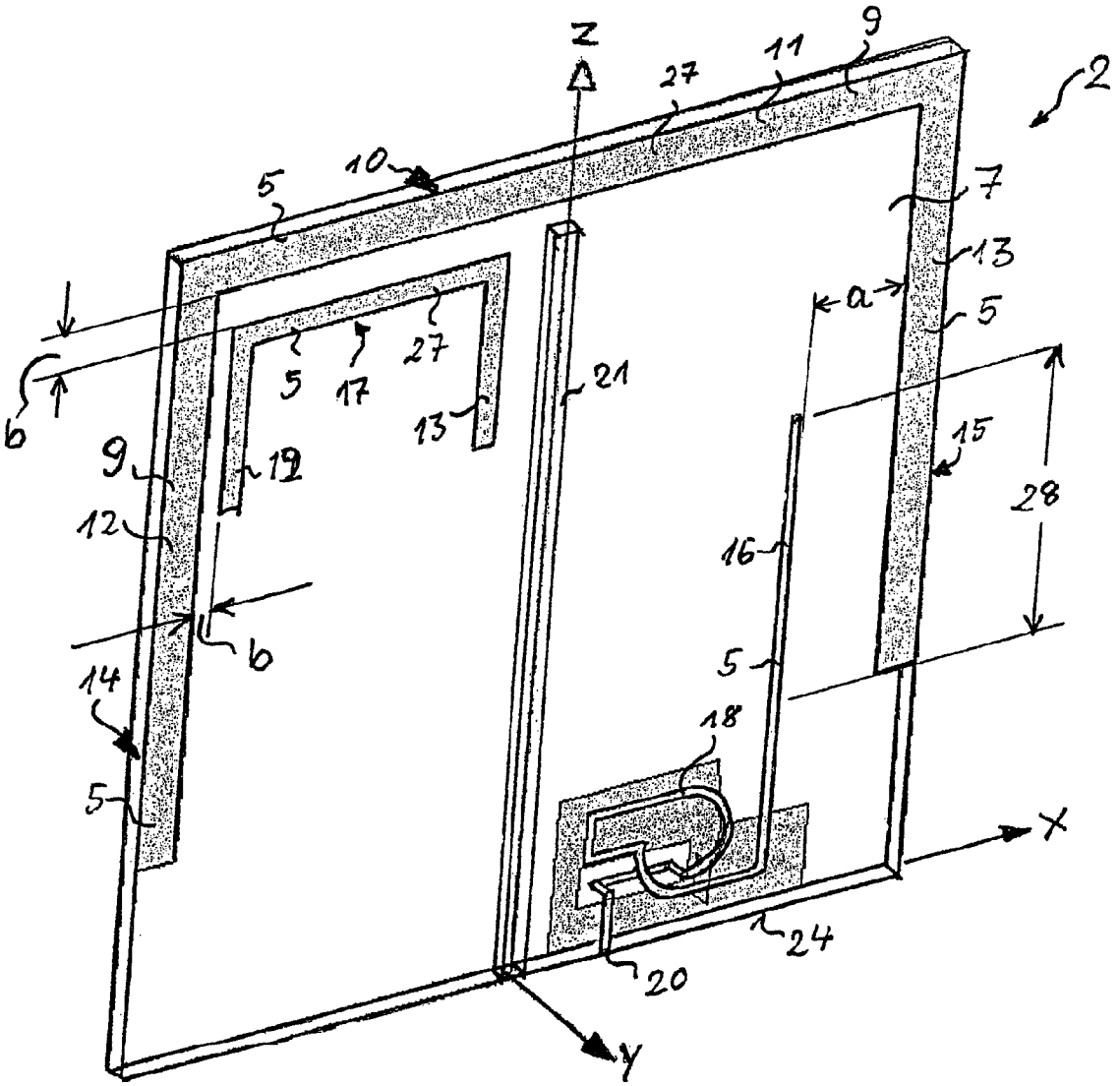
FIG. 2 shows a schematic perspective view of a substrate plate with an antenna structure according to a second example embodiment.

FIG. 2 shows a schematic perspective view of a substrate plate 7 with an antenna structure 2 according to a second example embodiment. Since the first substrate plate 6 and the second substrate plate 7 have identical electrically conductive structures 5 with the exception of the line element 27, arranged in the upper edge region 11, of the dipoles 8 and 9, the first substrate plate 6 is omitted from the example embodiments shown in FIGS. 2 to 4. Components with identical functions to those in FIG. 1 are characterized in FIGS. 2 to 4 by the same reference symbols and not explained separately.

The difference from the cruciform dipole in FIG. 1 is that in the case of the conductive structure 5 shown in FIG. 2 a further, second U-shaped dipole structure 17 is arranged which, in this second embodiment, is arranged with the first U-shaped dipole structure 11 over an electromagnetically coupling distance b between the dipole structures 10 and 17. The second U-shaped dipole structure 17 is configured for a higher frequency band than the first dipole structure 10. Accordingly, both the line element 27 and the limbs 13 and 14 are given correspondingly shorter dimensions.

While the first dipole structure 10 is provided for the transmission of Wimax data services in a frequency range between 2.3 GHz and 2.7 GHz or for a Europe-wide Wimax data service between 3.3 GHz and 3.8 GHz, a frequency band between 5.875 GHz and 5.925 GHz can be provided with the second U-shaped dipole structure 17 and therefore inter-vehicle information exchange services can be transmitted. These inter-vehicle information exchange services are intended to transmit safety-related information from vehicle to vehicle in road traffic in order therefore to warn about areas with traffic jams or weather conditions and to correspondingly indicate this acoustically or visually in each of the connected vehicles.

Figure 3:
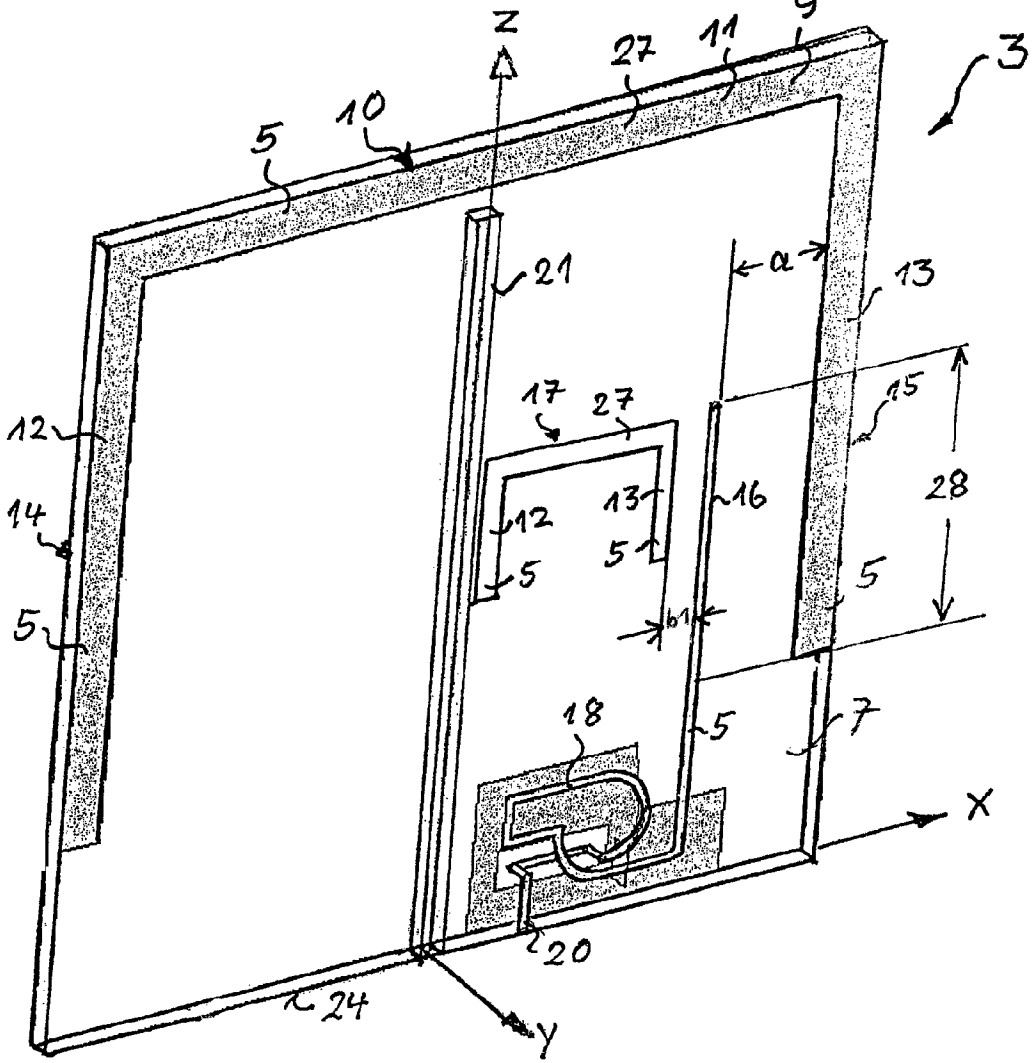
FIG. 3 shows a schematic perspective view of a substrate plate with an antenna structure according to a third example embodiment.

FIG. 3 shows a schematic perspective view of a substrate plate 7 (also representative of a corresponding substrate plate 6) with an antenna structure 3 according to a third example embodiment. The third embodiment differs from the second embodiment in that the second U-shaped dipole structure 17 is not coupled to the first dipole structure 10 but rather arranged at an electromagnetically coupling distance b1 from the monopole 16, and can therefore also be supplied by this monopole.

Figure 4:
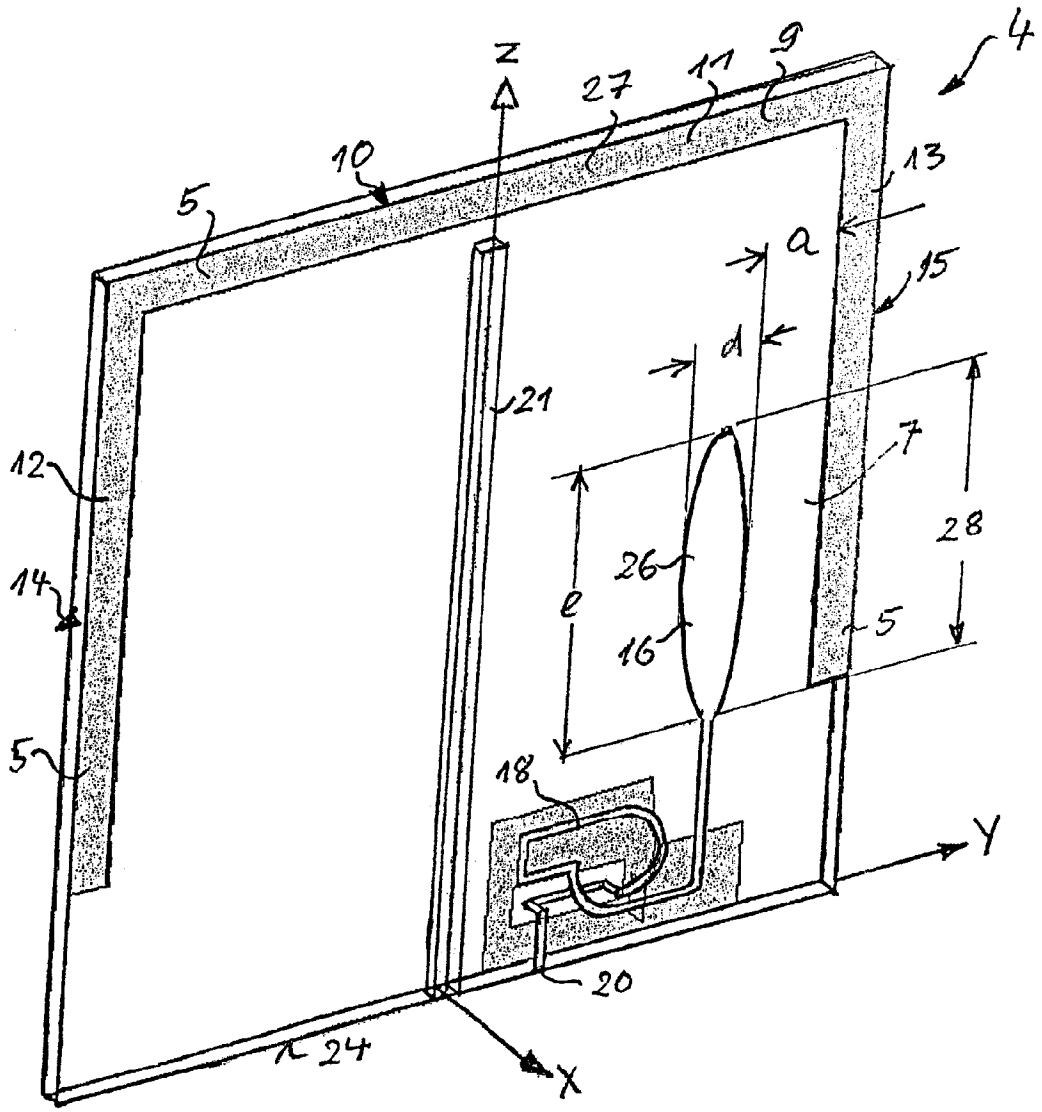
FIG. 4 shows a schematic perspective view of a substrate plate with an antenna structure according to a fourth example embodiment.

FIG. 4 shows a schematic perspective view of a substrate plate 7 (again also representative of a corresponding substrate plate 6) with an antenna structure 4 according to a fourth example embodiment. This embodiment differs from the preceding embodiments in that the monopole itself then serves the higher frequency band for an inter-vehicle exchange of information by virtue of the fact that the monopole antenna is structured in a correspondingly matched fashion. In this context, in this embodiment the monopole antenna is represented by an elliptical face which defines an upper frequency limit with its transverse extent, and defines a lower frequency limit with its longitudinal extent including the inductive extension through the coupling loop 18.

Therefore, by means of a single supply point 20 it is possible both for the vehicle to be connected to a Wimax data service and for it to interact with an inter-vehicle information exchange service. It is therefore possible for the asymmetrical actuation of the cruciform dipole to be used to make available a series of variants of a multiple-antenna system which can be structured in an extremely flexible and cost-effective way.

The following are disclosed: an antenna structure for a vehicle having electrically conductive structures 5 which are arranged on two insulating substrate plates 6, 7 which intersect at a right angle and are positioned perpendicularly on a lower supply region 29; at least two dipoles 8, 9 as electrically conductive structures, wherein firstly the two dipoles 8, 9 each form a U-shaped dipole structure 10 on the substrate plates 6, 7, and secondly wherein the U-shaped dipole structure 10 has a line element 27 on an upper edge region 11 of the substrate plate 6, 7, and electrically conductive limbs 12, 13, in contact with the line element, on side regions 14, 15 of the substrate plate 6, 7. In particular, in this context the electrically conductive structures 5 can each have a monopole arranged asymmetrically with respect to the dipole structure 10 at an electromagnetically coupling distance a from one of the limbs 12, 13 of the U-shaped dipole structure 10.

LIST OF REFERENCE NUMERALS

1 Antenna structure (1st embodiment)
2 Antenna structure (2nd embodiment)
3 Antenna structure (3rd embodiment)
4 Antenna structure (4th embodiment)
5 Conductive structure
6 Substrate plate
7 Substrate plate
8 Dipole
9 Dipole
10 First U-shaped dipole structure
11 Upper edge region
12 Limb
13 Limb
14 Side region
15 Side region
16 Monopole
17 Second U-shaped dipole structure
18 Coupling loop
19 Supply point
20 Supply point
21 Gap
22 Upper edge of the second plate
23 Gap-shaped recess
24 Lower edge region
25 Solder connection face
26 Ellipsoidal face
27 Line element
28 Coupling region
a Electromagnetically coupling distance from monopole to first dipole structure
b Electromagnetically coupling distance from first to second dipole structure
b' Electromagnetically coupling distance from second dipole structure to monopole
d Transverse extent of an ellipsoidal face
l Longitudinal extent of an ellipsoidal face

What is claimed is:

1. An antenna structure for a vehicle, comprising:

first and second insulating substrate plates that intersect each other at a right angle and which are positioned perpendicularly on a lower supply region; and an electrically conductive structure arranged on each of the first and second substrate plates, each electrically conductive structure comprising:

a first U-shaped dipole structure arranged on a corresponding one of the first and second substrate plates, the first U-shaped dipole structure comprising:

a line element on an upper edge region of the corresponding substrate plate, and two electrically conductive limbs on side regions of the corresponding substrate plate, and in electrical contact with the line element, and a monopole arranged on the corresponding substrate plate, asymmetrically with respect to the first U-shaped dipole structure arranged on the corresponding substrate plate, and at an electromagnetically coupling distance from one of the two electrically conductive limbs of the first U-shaped dipole structure arranged on the corresponding substrate, wherein a second U-shaped dipole structure for a higher frequency band is arranged on each of the first and second substrate plates, and wherein the dimensions of each second U-shaped dipole structure are smaller than the dimensions of the first U-shaped dipole structure on the corresponding substrate plate.

2. The antenna structure of claim 1, wherein each second U-shaped dipole structure is arranged at an electromagnetically coupling distance from the first U-shaped dipole structure on the corresponding substrate plate.

3. The antenna structure of claim 1, wherein each second U-shaped dipole structure is arranged at an electromagnetically coupling distance from the monopole on the corresponding substrate plate.

4. The antenna structure of claim 1, wherein each monopole is electrically connected to a supply point on the corresponding substrate plate via an inductive coupling loop or a matching network composed of line elements.

5. The antenna structure of claim 1, wherein the first substrate plate has a central vertical gap in which the second intersecting substrate plate is arranged.

6. The antenna structure of claim 1, wherein the intersecting first and second substrate plates have, at lower edge regions of each substrate plate, solder connection faces for surface-mounting on a horizontal component mounting board.

7. The antenna structure of claim 1, wherein each first U-shaped dipole structure is configured for frequencies f1 of a Wimax data service between 2.3 GHz≤f1≤2.7 GHz or between 2.496 GHz≤f1≤2.7 GHz or between 3.3 GHz≤f1≤3.8 GHz.

8. The antenna structure of claim 1, wherein each second U-shaped dipole structure is configured for frequencies f2 of an inter-vehicle information exchange service or "car-to-car" service between 5.875 GHz≤f2≤5.925 GHz or for frequencies f1 of a Wimax data service between 3.3 GHz≤f1≤3.8 GHz.

9. The antenna structure of claim 1, wherein each monopole is configured for the frequencies f2 of an inter-vehicle information exchange service or "car-to-car" service between 5.875 GHz≤f2≤5.925 GHz.

10. The antenna structure of claim 9, wherein each monopole has an ellipsoidal face whose longitudinal extent also determines a lower frequency limit of 5.875 GHz and whose transverse extent defines an upper frequency limit of 5.925 GHz.

11. A vehicle, comprising:

an antenna structure comprising:

first and second insulating substrate plates arranged at a right angle to one another and which intersect each other;

an electrically conductive structure arranged on each of the first and second substrate plates, each electrically conductive structure comprising:

a first U-shaped dipole structure arranged on a corresponding one of the first and second substrate plates, the first U-shaped dipole structure comprising:

a line element on an edge region of the corresponding substrate plate, and electrically conductive limbs on side regions of the corresponding substrate plate, and a monopole arranged on the corresponding substrate plate, asymmetrically with respect to the first U-shaped dipole structure arranged on the corresponding substrate plate, and arranged at an electromagnetically coupling distance from one of the two electrically conductive limbs of the first U-shaped dipole structure arranged on the corresponding substrate plate, wherein a second U-shaped dipole structure for a higher frequency band is arranged on each of the first and second substrate plates, and wherein the dimensions of each second U-shaped dipole structure are smaller than the dimensions of the first U-shaped dipole structure on the corresponding substrate plate.

12. The vehicle of claim 11, wherein each second U-shaped dipole structure is arranged at an electromagnetically coupling distance from the first U-shaped dipole structure on the corresponding substrate plate.

13. The vehicle of claim 11, wherein each second U-shaped dipole structure is arranged at an electromagnetically coupling distance from the monopole on the corresponding substrate plate.

14. The vehicle of claim 11, wherein each monopole is electrically connected to a supply point on the corresponding substrate plate via an inductive coupling loop or a matching network composed of line elements.

15. The vehicle of claim 11, wherein the first substrate plate has a central vertical gap in which the second intersecting substrate plate is arranged.

16. The vehicle of claim 11, wherein:

each first U-shaped dipole structure is configured for frequencies f1 of a Wimax data service between 2.3 GHz≤f1≤2.7 GHz or between 2.496 GHz≤f1≤2.7 GHz or between 3.3 GHz≤f1≤3.8 GHz; and each second U-shaped dipole structure is configured for frequencies f2 of an inter-vehicle information exchange service or "car-to-car" service between 5.875 GHz≤f2≤5.925 GHz or for frequencies f1 of a Wimax data service between 3.3 GHz≤f1≤3.8 GHz.

* * * * *